US009061850B2

(12) United States Patent
Watatani et al.

(10) Patent No.: US 9,061,850 B2
(45) Date of Patent: Jun. 23, 2015

(54) FIXING DEVICE, IMAGE FORMING APPARATUS, AND SHEET DETECTING MECHANISM

(71) Applicant: KYOCERA Document Solutions Inc., Osaka (JP)

(72) Inventors: Tomohiro Watatani, Osaka (JP); Hironori Takahashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/276,328

(22) Filed: May 13, 2014

(65) Prior Publication Data

US 2014/0339763 A1 Nov. 20, 2014

(30) Foreign Application Priority Data

May 16, 2013 (JP) ..... 2013-103701

(51) Int. Cl.

| | |
|---|---|
| ***B65H 7/02*** | (2006.01) |
| ***B65H 7/14*** | (2006.01) |
| ***B65H 7/20*** | (2006.01) |
| ***B65H 1/08*** | (2006.01) |

(52) U.S. Cl.

CPC .. *B65H 7/14* (2013.01); *B65H 7/20* (2013.01); *B65H 1/08* (2013.01); *B65H 2404/60* (2013.01); *B65H 2553/40* (2013.01); *B65H 2553/41* (2013.01); *B65H 2553/412* (2013.01); *B65H 2553/414* (2013.01); *B65H 2553/60* (2013.01); *B65H 2553/61* (2013.01); *B65H 2553/612* (2013.01); *B65H 2553/614* (2013.01)

(58) Field of Classification Search

CPC ..... B65H 2404/60; B65H 2553/40; B65H 2553/41; B65H 2553/412; B65H 2553/414; B65H 2553/60; B65H 2553/61; B65H 2553/612; B65H 2553/614; B65H 2553/81; B65H 2553/82

USPC ..... 271/264, 3.14, 265.01, 3.17

See application file for complete search history.

(56) References Cited

U.S. PATENT DOCUMENTS

| | | | | |
|---|---|---|---|---|
| 5,882,130 | A * | 3/1999 | Kumazaki et al. | 400/642 |
| 7,758,044 | B2 * | 7/2010 | Nonaka | 271/274 |
| 8,830,494 | B2 * | 9/2014 | Kuo et al. | 358/1.13 |
| 2004/0135311 | A1 * | 7/2004 | Chambers et al. | 271/265.01 |
| 2010/0247117 | A1 * | 9/2010 | Tomatsu | 399/21 |
| 2010/0295241 | A1 * | 11/2010 | Isogai | 271/227 |
| 2011/0062660 | A1 * | 3/2011 | Tokuda | 271/265.02 |
| 2013/0128294 | A1 * | 5/2013 | Kuo et al. | 358/1.13 |

FOREIGN PATENT DOCUMENTS

JP 2008-268401 A 11/2008

* cited by examiner

*Primary Examiner* — Prasad Gokhale
(74) *Attorney, Agent, or Firm* — Studebaker & Brackett PC

(57) ABSTRACT

A fixing device includes a sheet detecting mechanism configured to detect a sheet. The sheet detecting mechanism includes an actuator, a link member, and a detecting part. The actuator swings by being pushed by the sheet. The link member swings in conjunction with the swing of the actuator. The detecting part detects the swing of the link member. When a shift of a position of the actuator with respect to the detecting part is caused, the actuator slides with respect to the link member to absorb the shift.

16 Claims, 12 Drawing Sheets

FIXING DEVICE, IMAGE FORMING APPARATUS, AND SHEET DETECTING MECHANISM

INCORPORATION BY REFERENCE

This application is based on and claims the benefit of priority from Japanese Patent application No. 2013-103701 filed on May 16, 2013, the entire contents of which are incorporated herein by reference.

BACKGROUND

The present disclosure relates to a fixing device including a sheet detecting mechanism, an image forming apparatus including the fixing device, and the sheet detecting mechanism installed in the image forming apparatus.

An electrographic image forming apparatus such as a copier or a printer is provided with a fixing device configured to fix a toner image on a sheet. Some fixing devices include a sheet detecting mechanism detecting a sheet to judge whether or not a JAM (paper jamming) has occurred and to count the number of sheets on a basis of a detection result of the sheet detecting mechanism.

For instance, there exists a sheet detecting mechanism including an actuator, a light blocking plate revolving in a body with the actuator, and a detecting part detecting a displacement of the light blocking plate.

In the art described above, however, the actuator is attached to an openable/closable guide member and a position of the actuator shifts subtly from its original position as the guide member is repeatedly opened/closed. If the position of the actuator thus shifts, the position of the light blocking plate provided in a body with the actuator shifts with respect to the detecting part. Due to that, it becomes unable to accurately detect a displacement of the light blocking plate by the detecting part, and the sheet detecting mechanism may possibly cause an erroneous detection.

SUMMARY

In accordance with an embodiment of the present disclosure, a fixing device includes a sheet detecting mechanism configured to detect a sheet. The sheet detecting mechanism includes an actuator, a link member, and a detecting part. The actuator swings by being pushed by the sheet. The link member swings in conjunction with the swing of the actuator. The detecting part detects the swing of the link member. When a shift of a position of the actuator with respect to the detecting part is caused, the actuator slides with respect to the link member to absorb the shift.

Moreover, in accordance with an embodiment of the present disclosure, an image forming apparatus includes a fixing device. The fixing device includes a sheet detecting mechanism configured to detect a sheet. The sheet detecting mechanism includes an actuator, a link member, and a detecting part. The actuator swings by being pushed by the sheet. The link member swings in conjunction with the swing of the actuator. The detecting part detects the swing of the link member. When a shift of a position of the actuator with respect to the detecting part is caused, the actuator slides with respect to the link member to absorb the shift.

Furthermore, in accordance with an embodiment of the present disclosure, a sheet detecting mechanism is installed to an image forming apparatus. The sheet detecting mechanism includes an actuator, a link member, and a detecting part. The actuator swings by being pushed by the sheet. The link member swings in conjunction with the swing of the actuator. The detecting part detects the swing of the link member. When a shift of a position of the actuator with respect to the detecting part is caused, the actuator slides with respect to the link member to absorb the shift.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
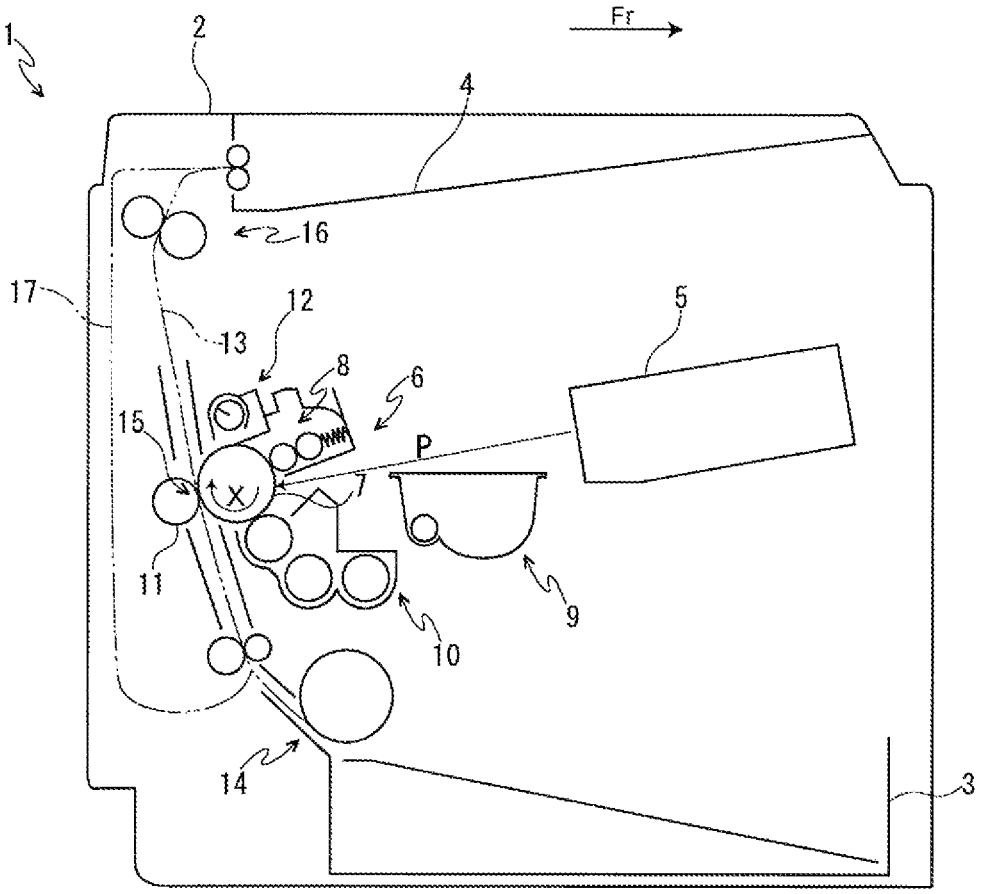
FIG. 1 is a schematic diagram showing a printer according to an embodiment of the present disclosure.

First, with reference to FIG. 1, the whole structure of a printer 1 (an image forming apparatus) will be described. FIG. 1 is a schematic diagram schematically showing the printer 1 in accordance with an embodiment of the present disclosure. Hereinafter, the right side of FIG. 1 will be described as a front side of the printer 1. Arrows Fr shown in each figure indicate the front side of the printer 1.

The printer 1 includes a box-formed printer main body 2. In a lower part of the printer main body 2, a sheet feeding cartridge 3 storing sheets (not shown) is installed and, in an upper end part of the printer main body 2, a sheet ejecting tray 4 is formed.

In a front part of the printer main body 2, an exposure device 5 composed of a laser scanning unit (LSU) is installed. In a rear part of the printer main body 2, an image forming part 6 is arranged. In the image forming part 6, a photosensitive drum 7 as an image carrier is rotatably installed. Around the photosensitive drum 7, a charging device 8, a development unit 10 connected to a toner container 9, a transferring roller 11, and a cleaning device 12 are located along a rotating direction (refer to an arrow X in FIG. 1) of the photosensitive drum 7.

In the rear part of the printer main body 2, a sheet conveying path 13 is arranged from a lower side to an upper side. At an upstream end in the conveying path 13, a sheet feeder 14 is positioned. At an intermediate stream part in the conveying path 13, a transferring part 15 composed of the photosensitive drum 7 and transferring roller 11 is positioned. At a downstream part in the conveying path 13, a fixing device 16 is positioned. In the rear side of the conveying path 13, an inversion path 17 for duplex printing is arranged.

Next, the operation of forming an image by the printer 1 having such a configuration will be described.

When the power is supplied to the printer 1, various parameters are initialized and initial determination, such as temperature determination of the fixing device 16, is carried out. Subsequently, in the printer 1, when image data is inputted and a printing start is directed from a computer or the like connected with the printer 1, image forming operation is carried out as follows.

First, the surface of the photosensitive drum 7 is uniformly electric-charged by the charging device 8. Then, exposure corresponding to the image data on the photosensitive drum 7 is carried out by a laser light (refer to an arrow P in FIG. 1) from the exposure device 5, thereby forming an electrostatic latent image on the surface of the photosensitive drum 7. Subsequently, the development unit 10 develops the electrostatic latent image by a toner (a developer) supplied from the toner container 9.

On the other hand, the sheet fed from the sheet feeding cartridge 3 by the sheet feeder 14 is conveyed to the transferring part 15 in a suitable timing for the above-mentioned image forming operation. Then, the toner image carried on the photosensitive drum 7 is transferred onto the sheet at the transferring part 15. The sheet with the transferred toner image is conveyed to a downstream side in the conveying path 13 to go forward to the fixing device 16, and then, the toner image is fixed on the sheet in the fixing device 16. The sheet with the fixed toner image is ejected from a downstream end in the conveying path 13 to the sheet ejecting tray 4. The toner remained on the photosensitive drum 7 is removed by the cleaning device 12.

Next, a configuration of the fixing device 16 will be described.

Figure 2:
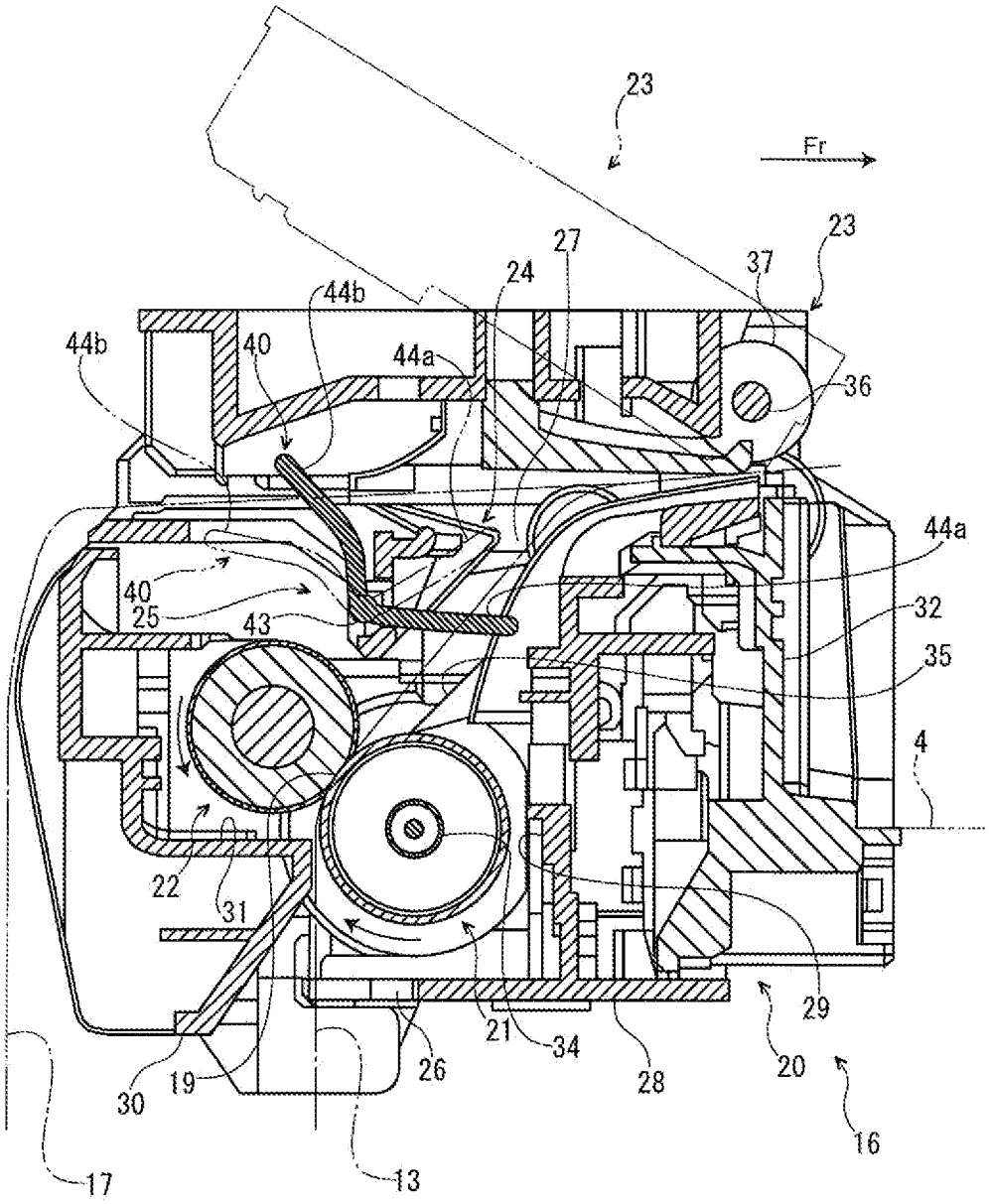
FIG. 2 is a section view showing a fixing device of the printer according to the embodiment of the present disclosure.

As shown in FIG. 2, the fixing device 16 includes a box-formed fixing device main body 20, a fixing roller 21 (first rotating body) stored at a center lower part of the fixing device main body 20, a pressing roller 22 (second rotating body) stored in a rear part of the fixing device main body 20, a cover member 23 covering an upper part of the fixing device main body 20, a guide member 24 mounted at a rear upper part of the fixing device main body 20, and a sheet detecting mechanism 25 disposed in a vicinity of the guide member 24.

A sheet feeding port 26 is provided at a lower end side of the fixing device main body 20 and a sheet discharging port 27 is provided at an upper end side of the fixing device main body 20. A sheet introduced into the fixing device main body 20 through the sheet feeding port 26 is discharged out of the fixing device main body 20 through the sheet discharging port 27.

A first frame member 28 is provided at a front part of the fixing device main body 20, and a fixing roller storing part 29 is formed in the first frame member 28.

A second frame member 30 is provided at a rear part of the fixing device main body 20. The second frame member 30 faces the first frame member 28 across the conveying path 13 of the sheet. A pressing roller storing part 31 is formed in the second frame member 30.

Figure 3:
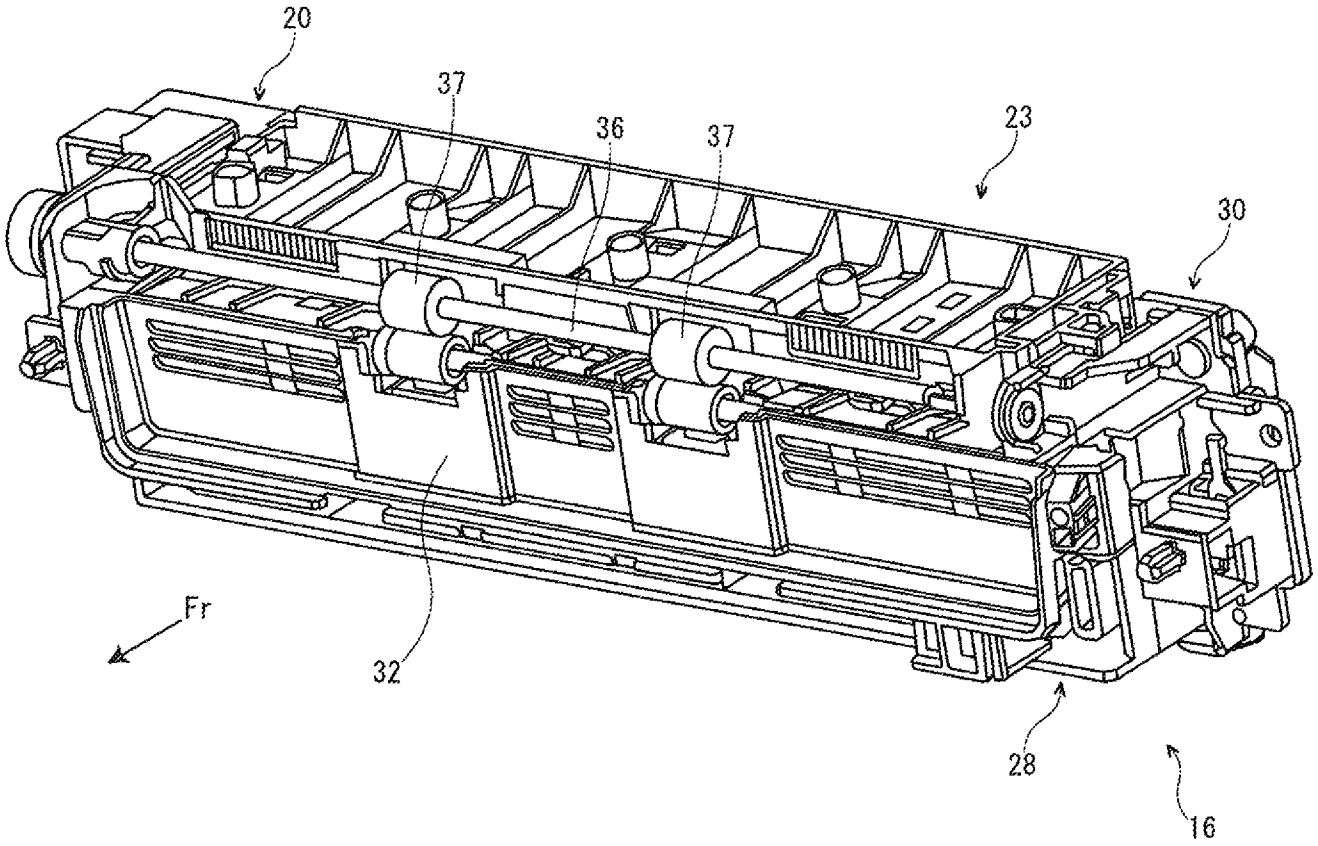
FIG. 3 is a perspective view showing the fixing device of the printer according to the embodiment of the present disclosure.
Figure 4:
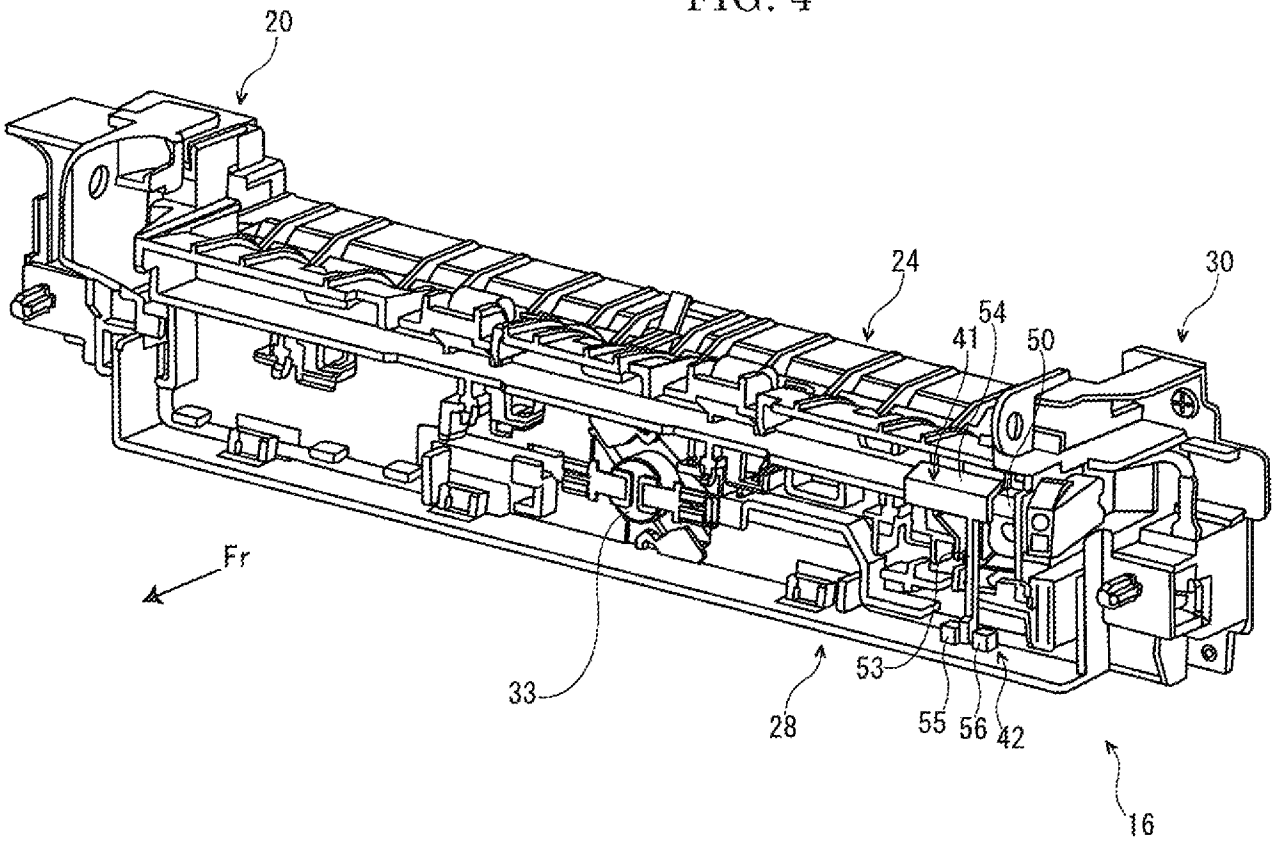
FIG. 4 is a front perspective view showing a fixing device main body and a guide member in the fixing device of the printer according to the embodiment of the present disclosure.

As shown in FIG. 3 and others, a covering body 32 is mounted at a front end part of the fixing device main body 20. The covering body 32 is formed into a flat plate and is formed in an elongated-shape in a horizontal direction. The covering body 32 covers a front side of the fixing device main body 20. As shown in FIG. 4 and others, a thermal cut-off part 33 is stored inside (rear side) of the covering body 32.

As shown in FIG. 2, the fixing roller 21 is stored in the fixing roller storing part 29 provided in the first frame member 28 of the fixing device main body 20. The fixing roller 21 is rotatably supported by the fixing device main body 20 through a bearing (not shown).

The fixing roller 21 is formed in an elongated-shape in the horizontal direction. The fixing roller 21 includes a cylindrical core member made of metal such as aluminum or steel, an elastic layer provided around the core member and made of silicone rubber or the like, and a release layer covering the elastic layer and made of fluororesin such as PFA.

A heater 34 (heat source) is stored within an inner space of the fixing roller 21. The heater 34 is composed by a halogen heater, a ceramic heater, or the like. The heater 34 is configured to generate heat by energization and to heat the fixing roller 21.

A separation craw 35 is provided at an upper side of the fixing roller 21 (downstream side in the sheet conveying direction). The separation craw 35 is in contact with an outer circumferential surface of the fixing roller 21 by being biased by a bias body (not shown). This configuration makes it possible to separate a sheet from the outer circumferential surface of the fixing roller 21 by the separation craw 35.

The pressing roller 22 is stored in the pressing roller storing part 31 provided in the second frame member 30 of the fixing device main body 20. The pressing roller 22 is rotatably supported by the second frame member 30 through a support member (not shown).

The pressing roller 22 is formed in an elongated-shape in the horizontal direction. The pressing roller 22 includes a cylindrical core member made of metal such as aluminum or steel, an elastic layer provided around the core member and made of silicone rubber or the like, and a release layer covering the elastic layer and made of fluororesin such as PFA. The pressing roller 22 comes in pressure contact with the fixing roller 21 by being biased by a bias body (not shown) and forms a fixing nip 19 between the fixing roller 21 and the pressing roller 22.

As shown in FIG. 3, the cover member 23 is formed in an elongated-shape in the horizontal direction. A rotational shaft 36 is provided at a front end side of the cover member 23 along the horizontal direction. A front end part of the cover member 23 is rotatably mounted to the rotational shaft 36, and the cover member 23 is opened/closed with respect to the fixing device main body 20 as the cover member 23 rotates centering on the rotational shaft 36 (see the cover member 23 indicated by a two-dot chain line in FIG. 2). A pair of right and left discharge rollers 37 are rotatably supported by the rotational shaft 36.

Figure 5:
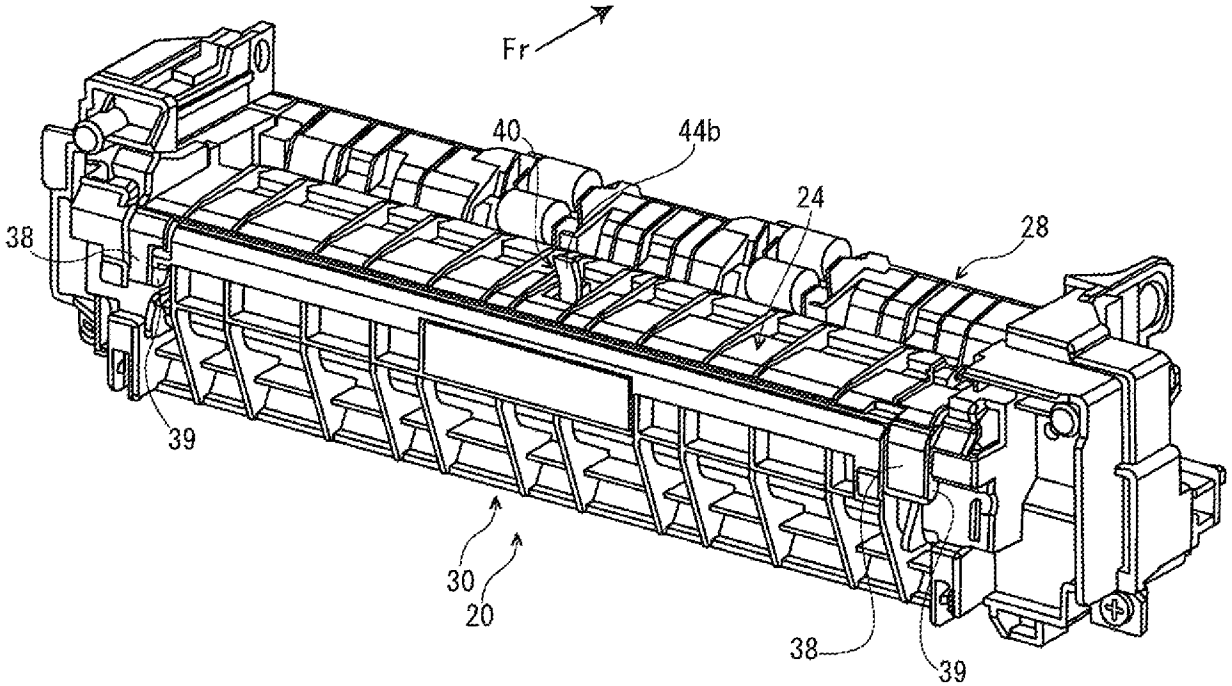
FIG. 5 is a back perspective view showing the fixing device main body and the guide member in the fixing device of the printer according to the embodiment of the present disclosure.

As shown in FIG. 5, the guide member 24 is formed in an elongated-shape in the horizontal direction. Arms 38 project in a direction vertical to the horizontal direction (downward in FIG. 5) at both right and left parts of the guide member 24. Shaft parts 39 are provided at edge parts (lower end part in FIG. 5) of the arms 38. The shaft parts 39 are rotatably mounted to the fixing device main body 20, and the guide member 24 is opened/closed to the fixing device main body 20 as the guide member 24 rotates centering on the shaft parts 39 (see FIGS. 6 and 7).

Figure 8:
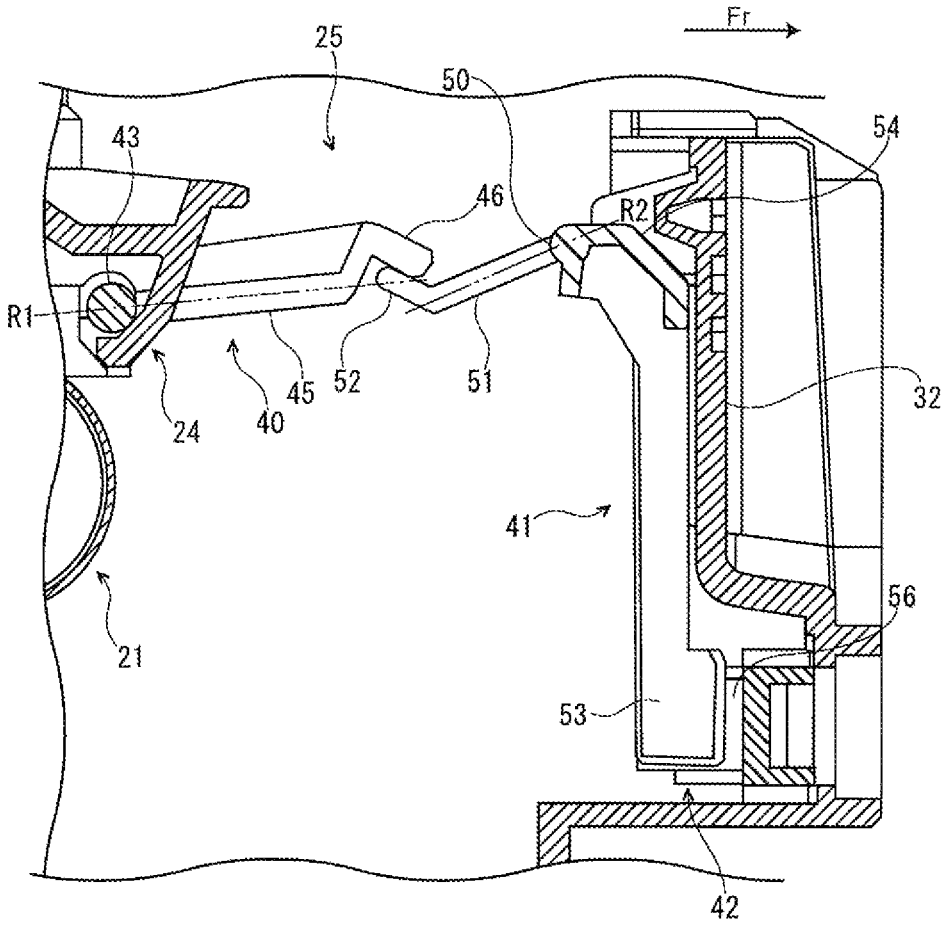
FIG. 8 is a section view showing a state in which an actuator is located at a project position and a link member is located at a first detection position in the fixing device of the printer according to the embodiment of the present disclosure.
Figure 9:
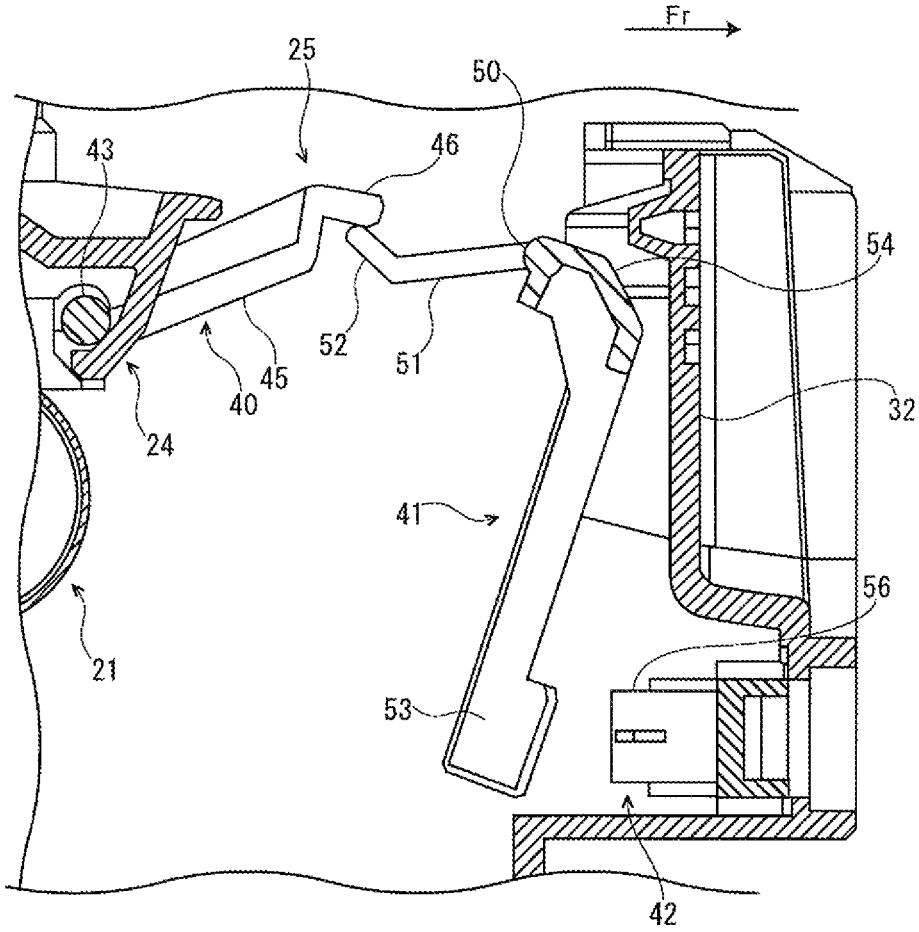
FIG. 9 is a section view showing a state in which the actuator is located at a setback position and the link member is located at a second detection position in the fixing device of the printer according to the embodiment of the present disclosure.

As shown in FIGS. 8 and 9, the sheet detecting mechanism 25 includes an actuator 40, a link member 41 disposed on a front side of the actuator 40, and a detecting part 42 disposed under the link member 41.

Figure 10:
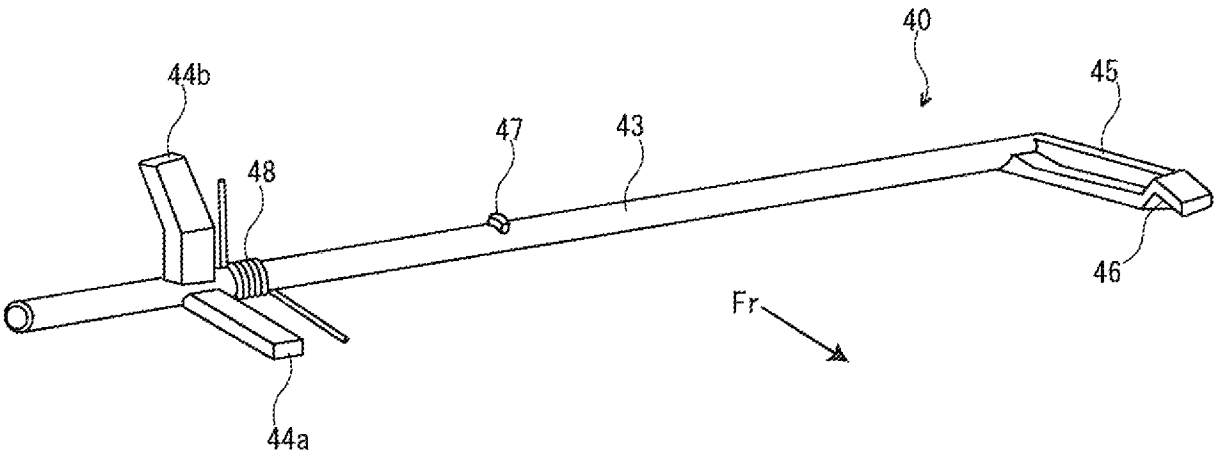
FIG. 10 is a perspective view showing the actuator in the fixing device of the printer according to the embodiment of the present disclosure.

As shown in FIG. 10, the actuator 40 includes a straight rod-shaped first swing shaft 43 extending in the horizontal direction, a pair of projecting plates 44*a* and 44*b* projecting forward and upward from a left side part of the first swing shaft 43, a first arm 45 projecting forward from a right end part of the first swing shaft 43, and a first hook 46 bent in a front downward direction from an edge part of the first arm 45.

The first swing shaft 43 is provided with a retaining projection 47 substantially at a center part in the horizontal direction thereof. As shown in FIGS. 8 and 9, the first swing shaft 43 is rotatably mounted to the guide member 24. Thereby, the actuator 40 is swingably supported by the guide member 24. As shown in FIG. 2, the actuator 40 is swingable centering on the first swing shaft 43 between a project position (see the actuator 40 indicated by a solid line in FIG. 2) where the projecting plate 44*a* projects to the conveying path 13 and the projecting plate 44*b* projects to the inversion path 17, and a setback position (see the actuator 40 indicated by a two-dot chain line in FIG. 2) where the projecting plate 44*a* sets back from the conveying path 13 and the projecting plate 44*b* sets back from the inversion path 17.

As shown in FIG. 10, a torsion coil spring (bias member) 48 is attached to the first swing shaft 43. The torsion coil spring 48 biases the actuator 40 toward the project position (see the actuator 40 indicated by the solid line in FIG. 2).

As shown in FIG. 8, the first arm 45 extends along a radial direction R1 of the first swing shaft 43. The first hook 46 extends in a direction inclined with respect to the radial direction R1 of the first swing shaft 43.

Figure 11:
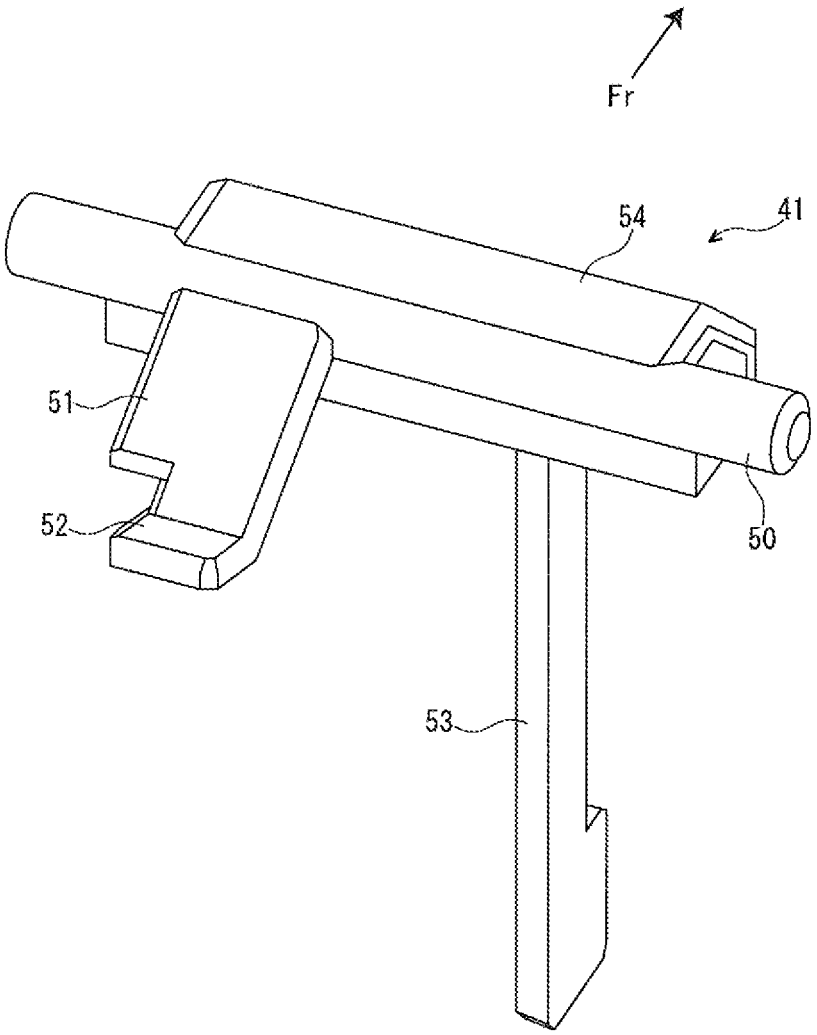
FIG. 11 is perspective view showing the link member in the fixing device of the printer according to the embodiment of the present disclosure.

As shown in FIG. 11, the link member 41 includes a straight rod-like second swing shaft 50 extending in the horizontal direction, a second arm 51 projecting from a right side part (left side part in FIG. 11) of the second swing shaft 50 in a rear downward direction, a second hook 52 bent from an edge part of the second arm 51 in a rear upward direction, a detection bar 53 extending downward from a left side part (right side part in FIG. 11) of the second swing shaft 50, and a reinforcing piece 54 provided around the second swing shaft 50.

The second swing shaft 50 is rotatably mounted to the first frame member 28 (see FIG. 12 and others) of the fixing device main body 20. Thereby, the link member 41 is swingably supported by the first frame member 28. The link member 41 is able to swing centering on the second swing shaft 50 between a first detection position (see the link member 41 indicated by a solid line in FIG. 12) and a second detection position (see the link member 41 indicated by a two-dot chain line in FIG. 12).

As shown in FIG. 8, the second arm. 51 extends along a radial direction R2 of the second swing shaft 50. The second hook 52 extends in a direction inclined with respect to the radial direction R2 of the second swing shaft 50. The second hook 52 engages slidably with the first hook 46 of the actuator 40. This configuration makes it possible for the actuator 40 to slide in the horizontal direction (in a front and rear direction) with respect to the link member 41.

Figure 12:
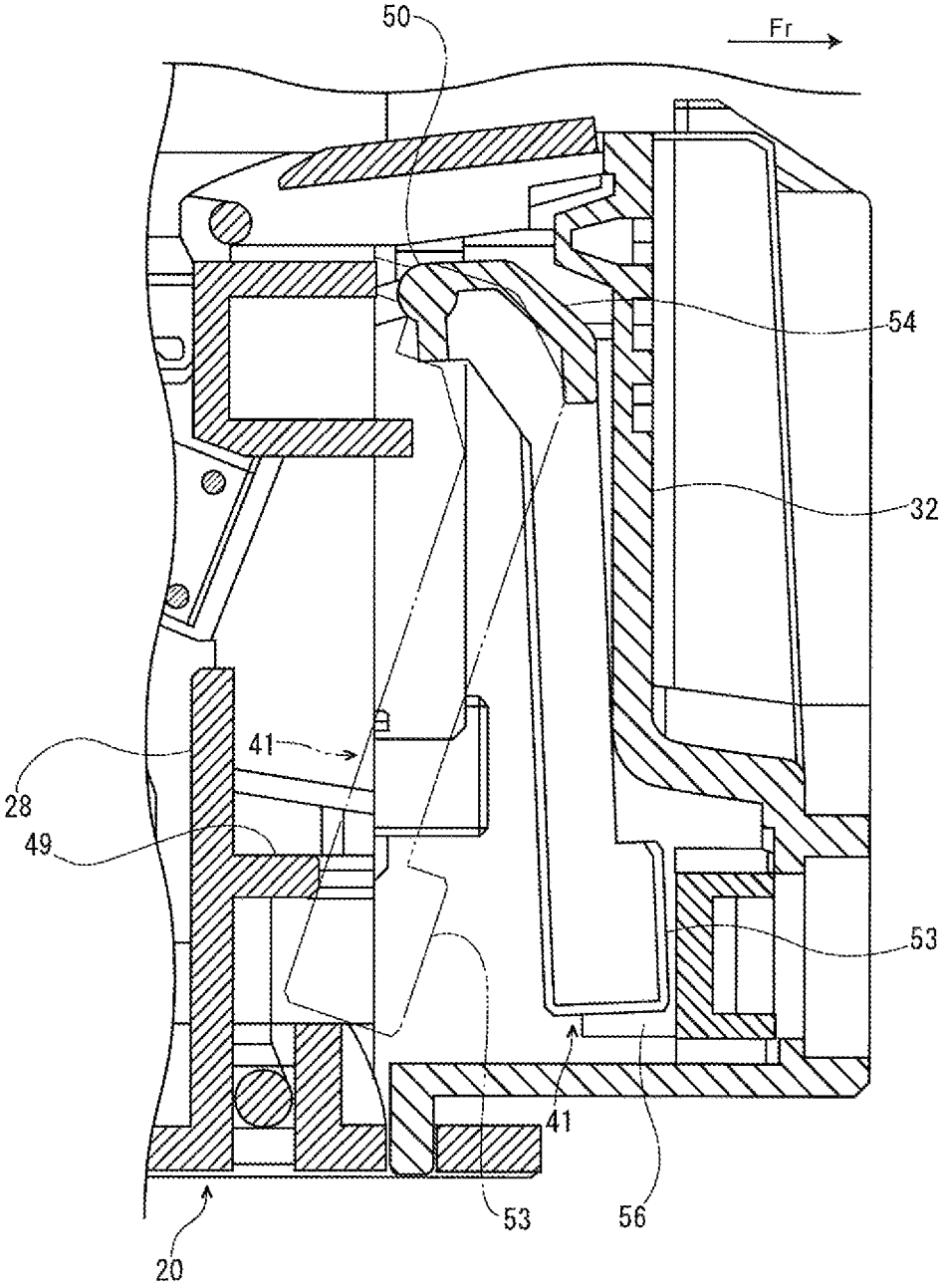
FIG. 12 is a section view showing the link member and a peripheral part thereof in the fixing device of the printer according to the embodiment of the present disclosure.

As shown in FIG. 12, the link member 41 is stored in a space surrounded by the first frame member 28 of the fixing device main body 20 and the covering body 32. The link member 41 is restricted from swinging rearward by a projection 49 provided on the first frame member 28 and is restricted from swinging forward by the covering body 32. That is, a swing range of the link member 41 is restricted by the first frame member 28 of the fixing device main body 20 and the covering body 32.

The detecting part 42 is a PI (Photo Interrupter) sensor and includes a light emitting part 55 and a light receiving part 56 disposed on aright side of the light emitting part 55 as shown in FIG. 4. The detecting part 42 is configured to detect the swing of the link member 41.

An operation of fixing a toner image on a sheet of the fixing device 16 configured as described above will be described.

In fixing a toner image on a sheet, the fixing roller 21 is heated by the heater 34 (see FIG. 2) and is rotated by a driving source (not shown). As the fixing roller 21 thus rotates, the pressing roller 22 coming in pressure contact with the fixing roller 21 rotates accompanying with the rotation of the fixing roller 21 in a direction opposite from a rotational direction of the fixing roller 21 (see arrows around the rollers in FIG. 2).

When the sheet on which the non-fixed toner image has been formed is conveyed from an upstream side (downside) along the conveying path 13 in this state, the sheet passes through the fixing nip 19. Thereby, the sheet and the toner image are heated and pressed, and the toner image is fixed to the sheet. The sheet that has passed through the fixing nip 19 is discharged to the sheet discharge tray 4 by the pair of right and left discharge rollers 37.

Next, a method for detecting the sheet by the sheet detecting mechanism 25 will be described.

When no sheet is fed, the actuator 40 is held at the project position (see the solid line in FIG. 2) by the bias force of the torsion coil spring 48. The time when no sheet is fed described above is a time when no sheet pushes the projection plates 44*a* and 44*b* of the actuator 40. Still further, as shown in FIG. 8, the link member 41 is located at the first detection position and the detection bar 53 of the link member 41 cuts off an optical path from the light emitting part 55 (not shown in FIG. 8) to the light receiving part 56 of the detecting part 42. Therefore, a detection result of the detecting part 42 is 'Low'.

Meanwhile, when a sheet is fed, the sheet conveyed along the conveying path 13 or the inversion path 17 pushes the projecting plate 44*a* or the projecting plate 44*b* of the actuator 40. Due to the push, the actuator 40 swings from the project position (see the solid line in FIG. 2) to the setback position (see the two-dot chain line in FIG. 2) against the bias force of the torsion coil spring 48. Due to the swing, the first arm 45 and the first hook 46 of the actuator 40 move upward as shown in FIG. 9. Along with that, the link member 41 swings from the first detection position to the second detection position by its own weight. Because the detection bar 53 of the link member 41 makes the optical path from the light emitting part 55 (not shown in FIG. 9) to the light receiving part 56 of the detecting part 42 communicate as the link member 41 swings, the detection result of the detecting part 42 turns out to be 'High'.

Thus, the detection result of the detecting part 42 when the link member 41 is located at the second detection position is different from the detection result when the link member 41 is located at the first detection position, so that the swing of the link member 41 can be detected by the detecting part 42.

It is noted that the first hook 46 of the actuator 40 is slidably engaged with the second hook 52 of the link member 41 in any states in which the link member 41 is located at the first detection position (the actuator 40 is located at the project position), the link member 41 is on a way of the swing from the first detection position to the second detection position (the actuator 40 is on a way of the swing from the project position to the setback position), and the link member 41 is located at the second detection position (the actuator 40 is located at the setback position).

Meanwhile, when a feeding of the sheet is finished and the pressure of the sheet to the projecting plate 44*a* or the projecting plate 44*b* of the actuator 40 is released, the actuator 40 swings from the setback position (see the two-dot chain line in FIG. 2) to the project position (see the solid line in FIG. 2) by the bias force of the torsion coil spring 48. Along with that, as shown in FIG. 8, the first hook 46 of the actuator 40 presses the second hook 52 of the link member 41, and the link member 41 swings from the second detection position to the first detection position. Due to this swing, the detection bar 53 of the link member 41 cuts off the optical path from the light emitting part 55 (not shown in FIG. 8) to the light receiving part 56 of the detecting part 42, and the detection result of the detecting part 42 turns out to be 'Low'.

Next, a JAM process (a process conducted when jamming occurs) will be described.

Figure 6:
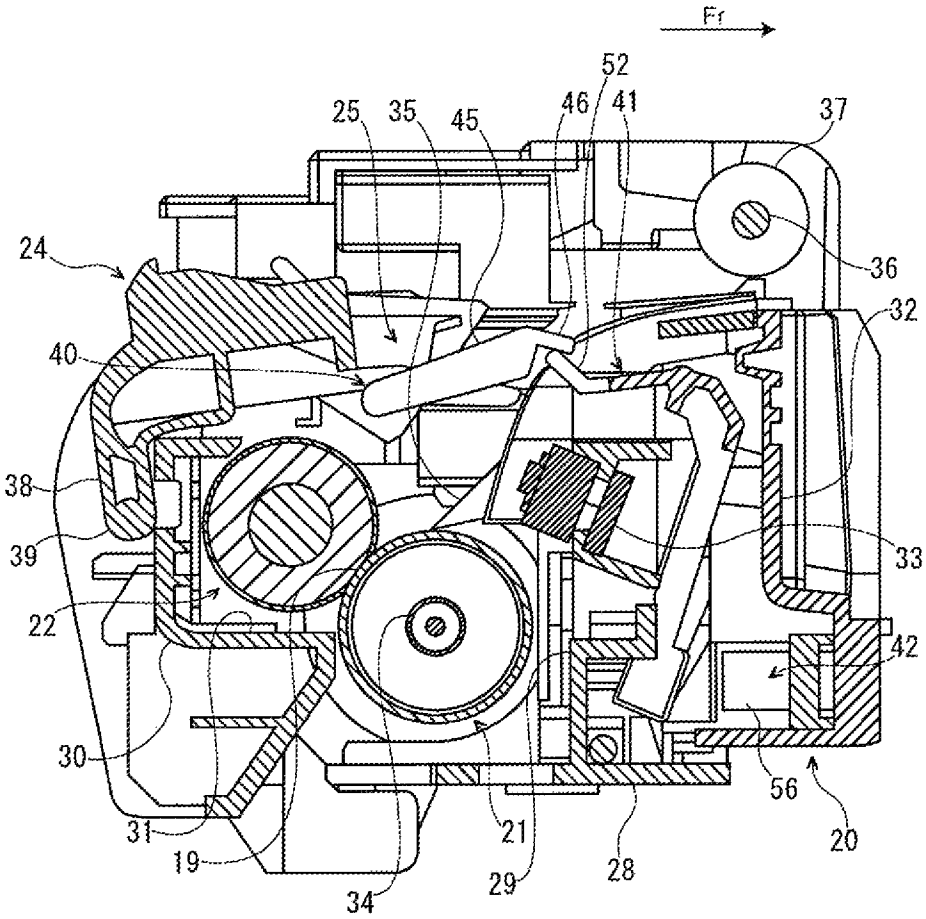
FIG. 6 is a section view showing a state in which the guide member is closed in the fixing device of the printer according to the embodiment of the present disclosure.
Figure 7:
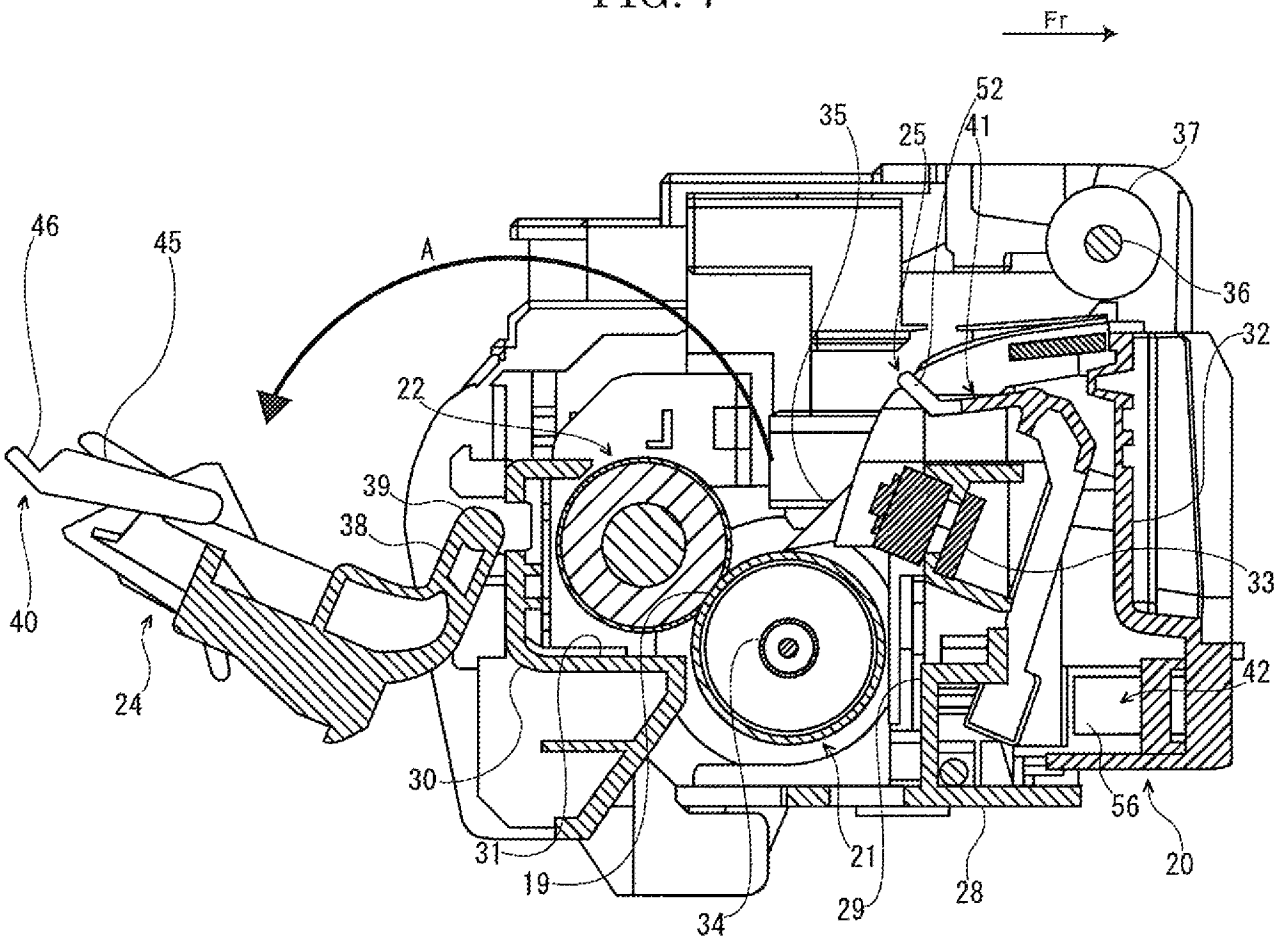
FIG. 7 is a section view showing a state in which the guide member is opened in the fixing device of the printer according to the embodiment of the present disclosure.

When a JAM occurs in the fixing device 16, a sheet jammed in the fixing device 16 pushes the projecting plate 44*a* or the projecting plate 44*b* of the actuator 40, so that the actuator 40 is located at the project position (see the solid line in FIG. 2). Still further, the link member 41 is located at the second detection position as shown in FIG. 6, and the detection result of the detecting part 42 is 'High'.

From this condition, an operator such as a user or a serviceman opens the cover member 23 at first as indicated by a two-dot chain line in FIG. 2. As the cover member 23 is thus opened, the guide member 24 becomes openable. Next, the operator opens the guide member 24 as indicated by an arrow A in FIG. 7. Along with that, the first hook 46 of the actuator 40 is disengaged from the second hook 52 of the link member 41. It is noted that even if the first hook 46 is disengaged from the second hook 52, the link member 41 still remains at the second detection position, so that the detection result of the detecting part 42 is kept to be 'High'.

Then, the operator performs the JAM process in the state in which the cover member 23 and the guide member 24 are opened. When the JAM process is finished, the operator closes the guide member 24. When the guide member 24 is thus closed, the first hook 46 of the actuator 40 engages slidably with the second hook 52 of the link member 41 and the actuator 40 is held at the project position (see the solid line in FIG. 2) by the bias force of the torsion coil spring 48. Due to that, the link member 41 swings from the second detection position to the first detection position as shown in FIG. 8 and the detection bar 53 of the link member 41 cuts off the optical path from the light emitting part 55 (not shown in FIG. 8) to the light receiving part 56 of the detecting part 42. Therefore, the detection result of the detecting part 42 turns out to be 'Low'.

After closing the guide member 24 as described above, the operator closes the cover member 23 at last. Thereby, a state in which a toner image can be fixed on a sheet is attained.

By the way, there is a case where a subtle shift occurs in terms of a position of the actuator 40 with respect to the detecting part 42 if the guide member 24 is repeatedly opened and closed as described above. However, even if such a shift occurs in terms of the position of the actuator 40 with respect to the detecting part 42, the shift is absorbed in the present embodiment as the actuator 40 slides in the horizontal direction with respect to the link member 41. This configuration makes it possible to keep the link member 41 at its original position, to stabilize the position of the link member 41, and to accurately detect the swing of the link member 41 by the detecting part 42. This configuration also makes it possible to securely prevent an erroneous detection of the sheet detecting mechanism 25.

The first hook 46 of the actuator 40 is engaged slidably with the second hook 52 of the link member 41 as described above in the present embodiment. The adoption of such configuration makes it possible to prevent the actuator from being disengaged from the link member 41 unintentionally. This configuration also makes it possible to prevent the erroneous detection of the sheet detecting mechanism 25 more securely.

Specifically, the link member 41 is always pulled to the actuator 40 side as the first hook 46 of the actuator 40 engages slidably with the second hook 52 of the link member 41 according to the present embodiment. Therefore, this configuration makes it possible to stabilize the position of the link member 41 further.

Still further, the actuator 40 is swingably supported by the guide member 24 and the link member 41 is swingably supported by the first frame member 28 of the fixing device main body 20. The adoption of such configuration makes it possible to use the sheet detecting mechanism 25 also for detecting opening/closing of the guide member 24. This makes it possible to simplify the configuration of the fixing device 16 as compared to a case where a mechanism for detecting opening/closing of the guide member 24 is installed in addition to the sheet detecting mechanism 25. Meanwhile, the actuator 40 is apt to be shifted from its original position when the guide member 24 is repeatedly opened/closed if the configuration described above is adopted. Therefore, the effect of stabilizing the position of the link member 41 by employing the configuration disclosed in the present disclosure is significant.

The present embodiment is also configured such that the guide member 24 becomes openable as the cover member 23 is opened as described above. Accordingly, the cover member 23 is necessarily opened if the guide member 24 is opened. Therefore, it is possible to understand that the cover member 23 is opened on a basis of the detection result of the sheet detecting mechanism 25.

The swing range of the link member 41 is restricted by the first frame member 28 of the fixing device main body 20 and the covering body 32 as described above. The adoption of such configuration makes it possible to prevent the link member 41 from swinging by exceeding its original swing range.

The present embodiment is also configured such that the actuator 40 swings by the pushing force of the sheet and the bias force of the torsion coil spring 48 and such that the link member 41 swings by the pressure of the actuator 40 and by its own weight. The adoption of such configuration makes it possible to securely make the actuator 40 and the link member 41 swing by using the simple structure.

While the case of using the torsion coil spring 48 as a bias member has been described in the present embodiment, it is also possible to use a coil spring, a plate spring, a wire spring or the like as a bias member according to other different embodiments.

While the case of separately opening/closing the cover member 23 and the guide member 24 has been described in the present embodiment, the guide member 24 may be opened/closed in linkage with opening/closing of the cover member 23 by connecting the cover member 23 with the guide member 24 through a link mechanism according to the other different embodiments.

While the case of composing the first rotating body by the fixing roller 21 and the second rotating body by the pressing roller 22 has been described in the present embodiment, one or both of the first and second rotating bodies may be composed by a belt according to the other different embodiments.

While the case of using the heater 34 as the heat source has been described in the present embodiment, a different heat source such as an IH coil may be used according to the other different embodiments.

While the case of applying the sheet detecting mechanism 25 to the fixing device 16 has been described in the present embodiment, the sheet detecting mechanism 25 may be applied also to the sheet feeding part 14 or the like according to the other different embodiments.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising a sheet detecting mechanism configured to detect a sheet, wherein the sheet detecting mechanism includes:

an actuator swinging by being pushed by the sheet;

a link member swinging in conjunction with the swing of the actuator; and a detecting part detecting the swing of the link member, when a shift of a position of the actuator with respect to the detecting part is caused, the actuator slides with respect to the link member to absorb the shift, the fixing device further comprises:

a first rotating body configured to be rotatable;

a second rotating body configured to be rotatable and to come in pressure contact with the first rotating body and to form a fixing nip between the first rotating body and the second rotating body;

a fixing device main body storing the first and second rotating bodies; and a guide member configured to be openable and closable to the fixing device main body, the actuator is supported swingably by the guide member, and the link member is supported swingably by the fixing device main body.

2. The fixing device according to claim 1, wherein the actuator includes:

a first swing shaft;

a first arm projecting from the first swing shaft and extending along a radial direction of the first swing shaft; and a first hook bent from the first arm, and the link member includes:

a second swing shaft;

a second arm projecting from the second swing shaft and extending along a radial direction of the second swing shaft; and a second hook bent from the second arm, and the first hook is configured to engage slidably with the second hook.

3. The fixing device according to claim 2, wherein the detecting part is a PI sensor including a light emitting part and a light receiving part, and the link member further includes a detection bar extending from the second swing shaft, and the detection bar is configured to be able to cut off an optical path from the light emitting part to the light receiving part.

4. The fixing device according to claim 2, wherein the link member further includes a reinforcing piece provided around the second swing shaft.

5. The fixing device according to claim 1, further comprising a cover member configured to be openable and closable to the fixing device main body, wherein the guide member becomes openable as the cover member is opened.

6. The fixing device according to claim 1, further comprising a covering body configured to cover a part of the fixing device main body, wherein a swing range of the link member is restricted by the fixing device main body and the covering body.

7. The fixing device according to claim 1, wherein the actuator is swingable between a project position where the actuator projects to a sheet conveying path and a setback position where the actuator sets back from the conveying path and the actuator is biased to the project position by a bias member, and the link member is swingable between a first detection position and a second detection position where a detection result of the detecting part is different from a detection result of the detecting part of the first detection position.

8. The fixing device according to claim 1, wherein the actuator is slidable in a horizontal direction with respect to the link member.

9. An image forming apparatus comprising a fixing device including a sheet detecting mechanism configured to detect a sheet, wherein the sheet detecting mechanism includes:

an actuator swinging by being pushed by the sheet;

a link member swinging in conjunction with the swing of the actuator; and a detecting part detecting the swing of the link member, when a shift of a position of the actuator with respect to the detecting part is caused, the actuator slides with respect to the link member to absorb the shift, and the fixing device further includes:

a first rotating body configured to be rotatable;

a second rotating body configured to be rotatable and to come in pressure contact with the first rotating body and to form a fixing nip between the first rotating body and the second rotating body;

a fixing device main body storing the first and second rotating bodies; and a guide member configured to be openable and closable to the fixing device main body, wherein the actuator is supported swingably by the guide member, and the link member is supported swingably by the fixing device main body.

10. The image forming apparatus according to claim 9, wherein the actuator includes:

a first swing shaft;

a first arm projecting from the first swing shaft and extending along a radial direction of the first swing shaft; and a first hook bent from the first arm, and the link member includes:

a second swing shaft;

a second arm projecting from the second swing shaft and extending along a radial direction of the second swing shaft; and a second hook bent from the second arm, and the first hook is configured to engage slidably with the second hook.

11. The image forming apparatus according to claim 10, wherein the detecting part is a PI sensor including a light emitting part and a light receiving part, and the link member further includes a detection bar extending from the second swing shaft, and the detection bar is configured to be able to cut off an optical path from the light emitting part to the light receiving part.

12. The image forming apparatus according to claim 10, wherein the link member further includes a reinforcing piece provided around the second swing shaft.

13. The image forming apparatus according to claim 9, wherein the fixing device further includes a cover member configured to be openable and closable to the fixing device main body, and the guide member becomes openable as the cover member is opened.

14. The image forming apparatus according to claim 9, wherein the fixing device further includes a covering body configured to cover a part of the fixing device main body, and a swing range of the link member is restricted by the fixing device main body and the covering body.

15. The image forming apparatus according to claim 9, wherein the actuator is swingable between a project position where the actuator projects to a sheet conveying path and a setback position where the actuator sets back from the conveying path and the actuator is biased to the project position by a bias member, and the link member is swingable between a first detection position and a second detection position where a detection result of the detecting part is different from a detection result of the detecting part of the first detection position.

16. The image forming apparatus according to claim 9, wherein the actuator is slidable in a horizontal direction with respect to the link member.

* * * * *